United States Patent [19]

Hankley

[11] Patent Number: 4,622,016

[45] Date of Patent: Nov. 11, 1986

[54] TUNNEL WEDGE

[75] Inventor: Donald W. Hankley, Virginia Beach, Va.

[73] Assignee: The United States of America as represented by the Secretary of the Navy, Washington, D.C.

[21] Appl. No.: 208,754

[22] Filed: Nov. 20, 1980

[51] Int. Cl.[4] ..... B63H 5/16

[52] U.S. Cl. ..... 440/70; 440/68; 440/69

[58] Field of Search ..... 440/66, 67, 68, 69, 440/70; 114/288

[56] References Cited

U.S. PATENT DOCUMENTS

| | | | |
|---|---|---|---|
| 1,108,340 | 8/1914 | Criqui | 440/69 |
| 1,163,075 | 12/1915 | Fowler | 440/70 |
| 1,401,963 | 1/1922 | Criqui | 440/69 |
| 2,812,738 | 11/1954 | Munro | 115/39 |
| 3,112,610 | 12/1963 | Jerger | 440/67 |
| 3,450,090 | 3/1968 | Best, Jr. | 115/39 |
| 3,572,281 | 3/1971 | Becker | 440/66 |
| 3,626,894 | 6/1970 | Stuart | 115/39 |
| 3,793,980 | 2/1974 | Sherman | 440/69 |
| 3,893,405 | 7/1975 | Lais et al. | 440/40 |
| 3,934,538 | 5/1974 | Canazzi | 115/39 |
| 3,937,173 | 9/1974 | Stuart | 115/39 |
| 4,278,431 | 7/1981 | Krastkremer et al. | 114/151 |
| 4,300,889 | 11/1981 | Wormser | 440/69 |

FOREIGN PATENT DOCUMENTS

| | | | |
|---|---|---|---|
| 740224 | 10/1943 | Fed. Rep. of Germany | 440/67 |
| 1364903 | 11/1964 | France | 440/67 |

*Primary Examiner*—Trygve M. Blix
*Assistant Examiner*—C. T. Bartz
*Attorney, Agent, or Firm*—R. F. Beers; T. E. McDonnell

[57] ABSTRACT

A full or partial tunnel wedge is positioned in the propeller shaft tunnel aft of the propeller on a waterborne craft. The size and angle of the wedge is determined by the characteristics of the particular craft. The wedge converges water flow and increases water pressure aft of the propeller. The higher water pressure increases the propeller thrust and reduces the hull drag of the propeller shaft tunnel thus reducing the shaft horsepower required to maintain a given speed.

2 Claims, 22 Drawing Figures

TUNNEL WEDGE

STATEMENT OF GOVERNMENT INTEREST

The invention described herein may be manufactured and used by and for the United States of America for governmental purposes without the payment of any royalties thereon or therefor.

BACKGROUND OF THE INVENTION

The present invention relates to a full or partial tunnel wedge positioned in a propeller shaft tunnel aft of the propeller on a waterborne craft which increases water pressure aft of the propeller and reduces the shaft horsepower required to maintain a given speed.

Existing propeller shaft technology does not allow the water aft of the propeller to converge. Prior art shaft tunnels include those disclosed by Stuart, U.S. Pat. No. 3,515,087, U.S. Pat. No. 3,626,894, and U.S. Pat. No. 3,937,173. In all of the Stuart patents the propeller shaft tunnel is flared out aft of the propeller so as to meet the stern transom and allow the water flow to diverge.

Additional prior art shaft tunnels are disclosed in Munro, U.S. Pat. No. 2,812,738, and Wollard, U.S. Pat. No. 3,469,557. Both Munro and Wollard disclose shaft tunnels wherein the top of the channel aft of the propeller slopes downward. Neither Munro nor Wollard disclose a shaft tunnel which converges aft of the propeller so as to increase propeller thrust and reduce the hull drag of the shaft tunnel.

SUMMARY OF THE INVENTION

Accordingly, there is provided in the present invention a full or partial tunnel wedge positioned in the propeller shaft tunnel aft of the propeller on a waterborne craft which increases water pressure aft of the propeller and reduces the shaft horsepower required to maintain a given speed. The reduction in horsepower will yield a reduction in fuel consumption and increased operating range.

The wedge is constructed of wood, metal, fiberglass, epoxy resin or equivalent material and positioned in the semi-cylindrical propeller shaft tunnel. The size and ramp angle of the wedge is determined for each particular craft based on the operational characteristics of the craft. Whether the wedge is a full or partial wedge is determined by the dynamic trimming characteristics of the craft.

The full or partial tunnel wedge converges water flow aft and increases water pressure aft of the propeller. The higher water pressure increases the propeller thrust and reduces the hull drag of the propeller shaft tunnel thus reducing the shaft horsepower and fuel consumption required for a given speed while increasing the operating range.

OBJECTS OF THE INVENTION

It is an object of the present invention to provide a tunnel wedge for a propeller shaft tunnel that converges water flow aft of the propeller.

Another object is to provide a tunnel wedge that increases the water pressure aft of the propeller.

Yet another object is to provide a tunnel wedge for a propeller shaft tunnel that reduces the shaft horsepower required to obtain operating speed.

A still further object of the invention is to provide a tunnel wedge that reduces fuel consumption and increases operating range.

Other objects, advantages and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
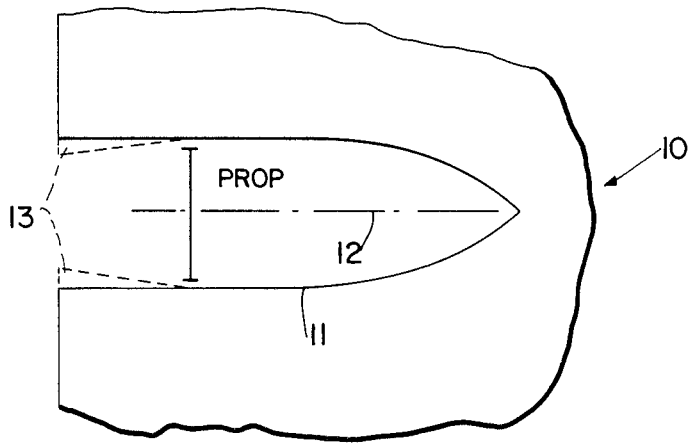
FIG. 1 shows a partial schematic illustration of the bottom of the craft, propeller shaft tunnel, and tunnel wedge of the subject invention.
Figure 2:
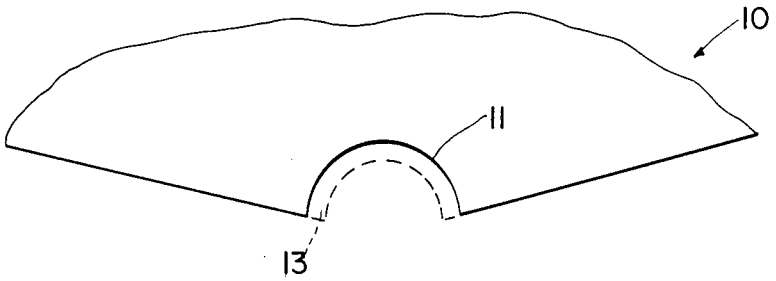
FIG. 2 shows a partial schematic illustration of the back of the craft, propeller shaft tunnel and tunnel wedge.

Referring to FIGS. 1 and 2, there is illustrated in schematic form the bottom stern of a waterborne craft 10 having a semi-cylindrical propeller shaft tunnel 11 in which is positioned propeller shaft 12. Shaft tunnel 11 is provided with tunnel wedge 13, illustrated by dotted lines.

Wedge 13 can be constructed of wood, metal, fiberglass, epoxy resin or any other suitable material and can be attached to the shaft tunnel by any suitable attachment means. The size and ramp angle of the wedge is determined for each particular craft based on the operating characteristics of each craft. Whether the wedge is a full or partial wedge is determined by the dynamic trimming characteristics of each craft.

Figure 3A:
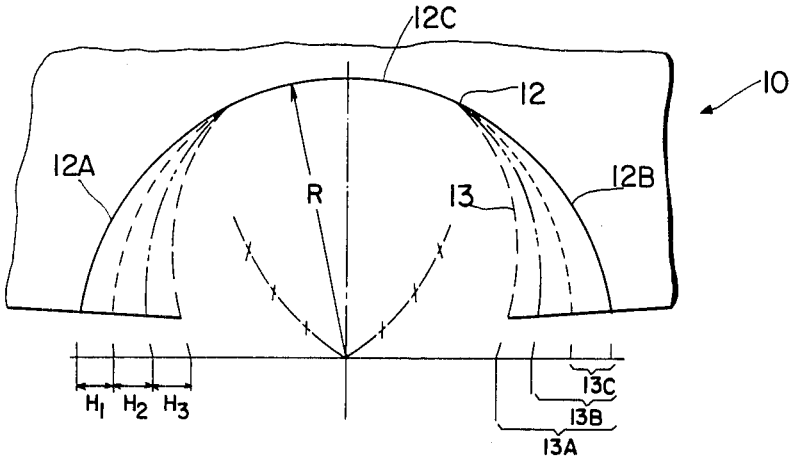
FIGS. 3A, 3B and 3C illustrate a first embodiment of the tunnel wedge.
Figure 3B:
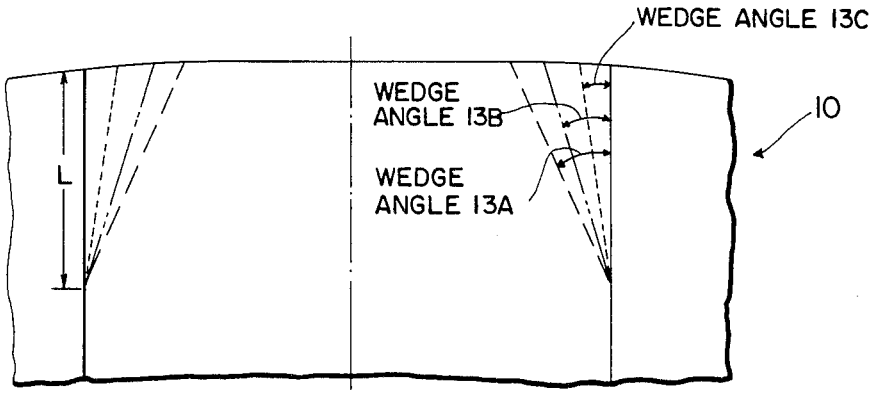
Figure 3C:
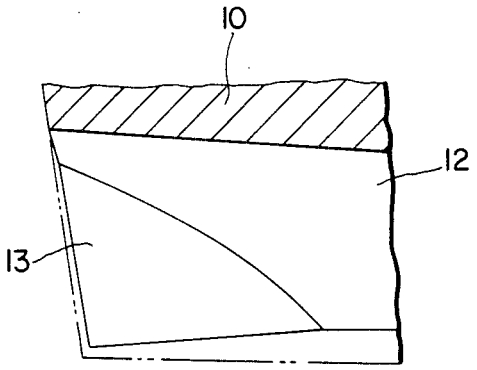

Referring now to FIGS. 3A, 3B and 3C, there are shown views of a first embodiment of tunnel wedge 13 positioned in shaft tunnel 12 of a waterborne craft 10 such as a LCP(L) MK 11 Hull 36PL6641, for example.

As shown in FIGS. 3A and 3B, tunnel wedge 13 can be a partial wedge extending inward from the sides 12A and 12B of tunnel shaft 12 while leaving top 12C open to the original tunnel circumference. Tunnel wedge 13 may be built up in segments so as to yield wedge sizes 13A, 13B and 13C. As shown in FIGS. 3A and 3C, the partial tunnel wedge of this embodiment tapers downward to the bottom of craft 10 as wedge 13 extends forward into the tunnel. The inner faces of wedges 13A, 13B and 13C are curved to form concave surfaces.

By way of illustration, for a waterborne craft such as an LCP(L) MK 11 Hull 36PL6641 having a shaft tunnel radius R of 14 inches, a wedge length L of 12 inches, and wedge heights $H_1$, $H_2$, and $H_3$ of 2 inches respectively, Table I illustrates the percent of tunnel exit area closed by partial wedges 13A, 13B and 13C.

TABLE I

| WEDGE | WEDGE ANGLE DEGS | PERCENT OF TUNNEL EXIT AREA CLOSED |
|---|---|---|
| 13A | 23.6 | 0.23 |
| 13B | 16.3 | 0.16 |
| 13C | 8.3 | 0.09 |

Figure 4A:
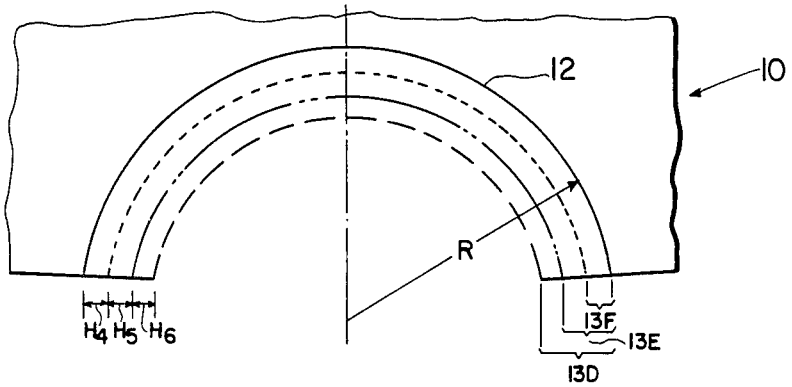
FIGS. 4A, 4B and 4C illustrate a second embodiment of the tunnel wedge.
Figure 4B:
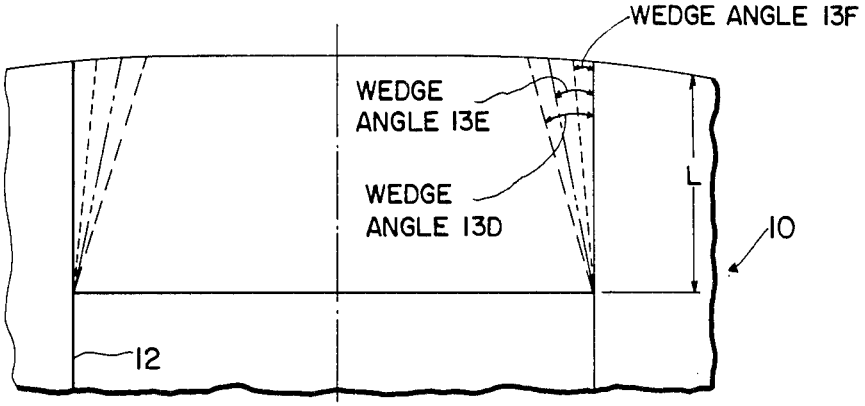
Figure 4C:
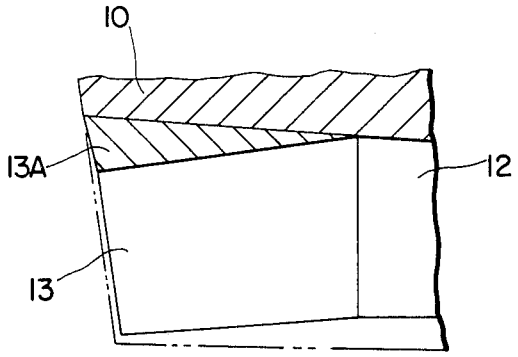

FIGS. 4A, 4B and 4C show views of a second embodiment of tunnel wedge 13 wherein the wedge is a full wedge positioned in shaft tunnel 12 so as to extend inward over the entire circumference of shaft tunnel 12. The full wedge can be built up in segments to as to yield wedge sizes 13D, 13E and 13F.

By way of illustration, for a waterborne craft such as an LCP(L) MK 11 Hull 36PL6641 having a shaft tunnel radius of 14 inches, a wedge length L of 12 inches, and wedge heights $H_4$, $H_5$, and $H_6$ of $1\frac{1}{4}$ inches, respectively, Table II illustrates the percent of tunnel exit area closed by full wedges 13D, 13E and 13F.

TABLE II

| WEDGE | WEDGE ANGLE DEGS | PERCENT OF TUNNEL EXIT AREA CLOSED |
|---|---|---|
| 13D | 17.0 | 0.48 |
| 13E | 11.5 | 0.34 |
| 13F | 6.5 | 0.18 |

Figure 5A:
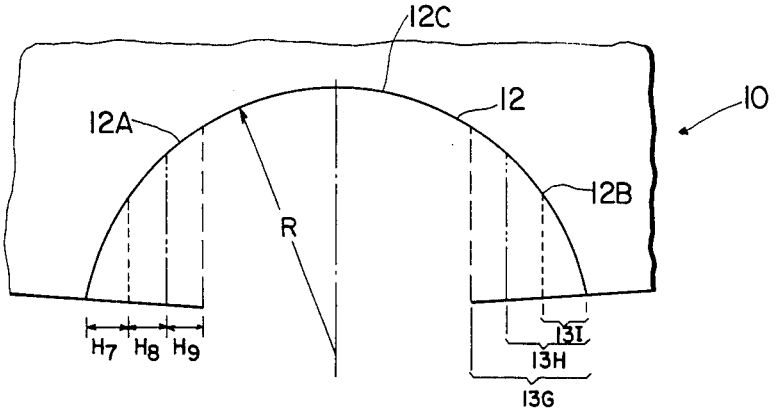
FIGS. 5A, 5B and 5C illustrate a third embodiment of the tunnel wedge.
Figure 5B:
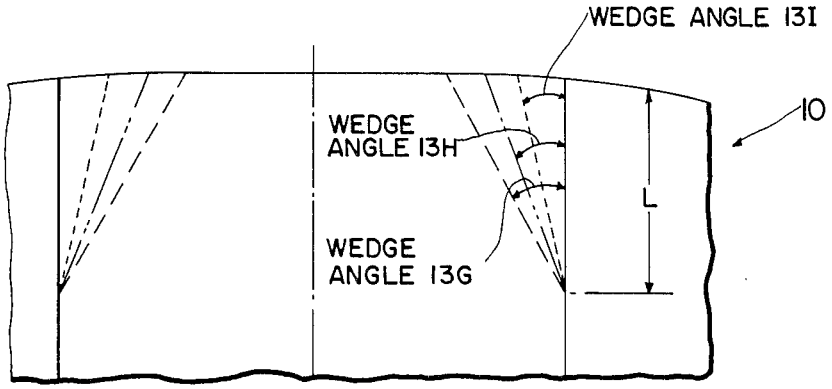
Figure 5C:
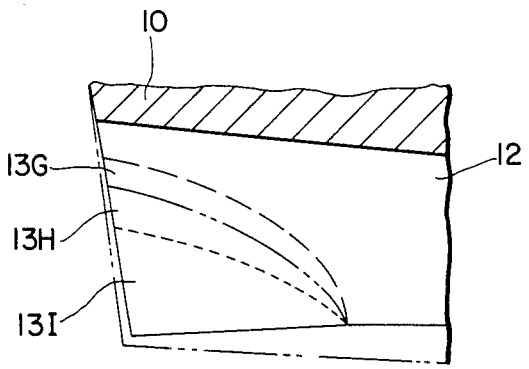
Figure 6A:
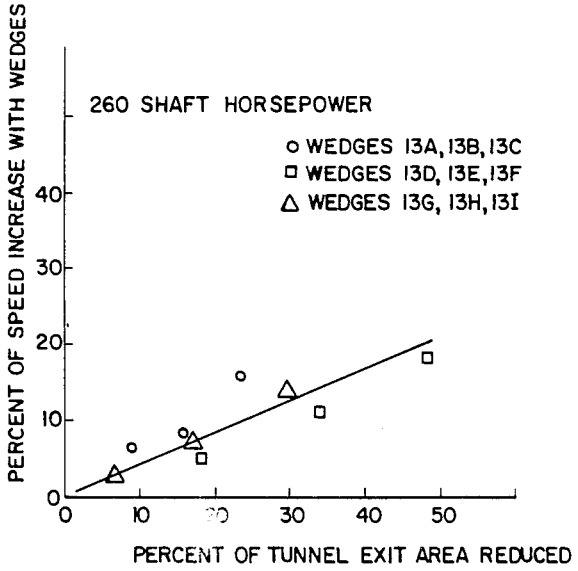
FIGS. 6A–G illustrate in graphic form the percentage of speed increase versus percentage of reduced tunnel exit area for the various embodiments of the invention with engines of various shaft horsepower.
Figure 6B:
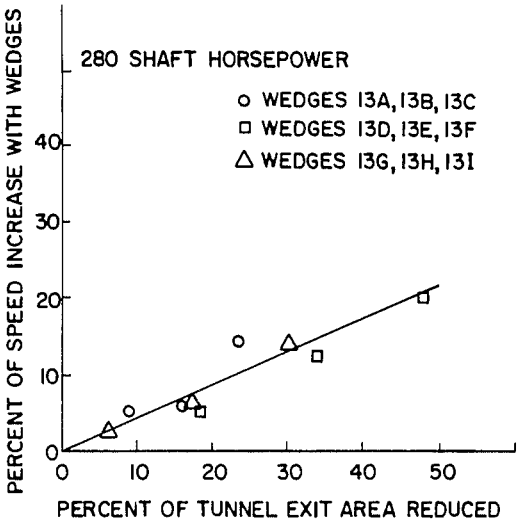
Figure 6C:
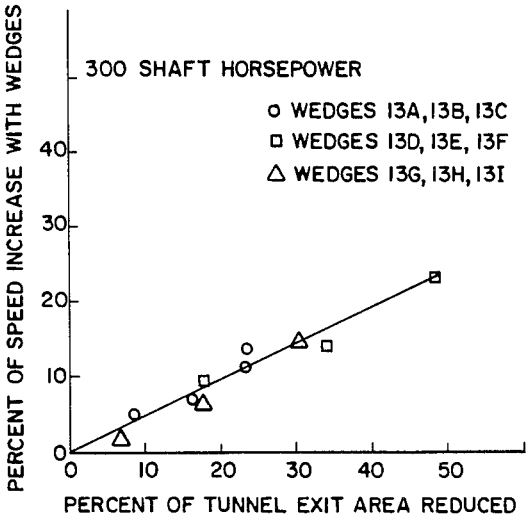
Figure 6D:
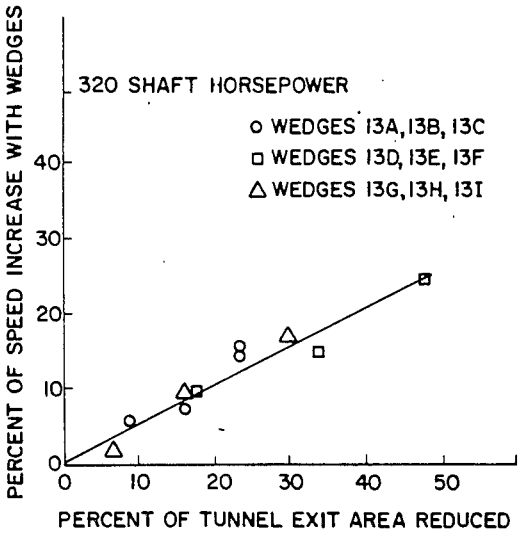
Figure 6E:
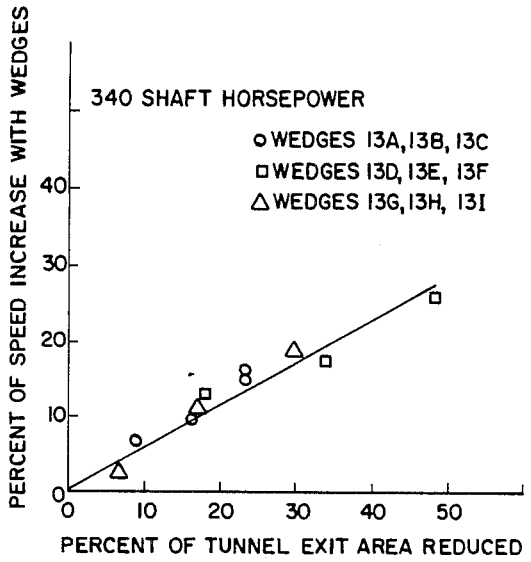
Figure 6F:
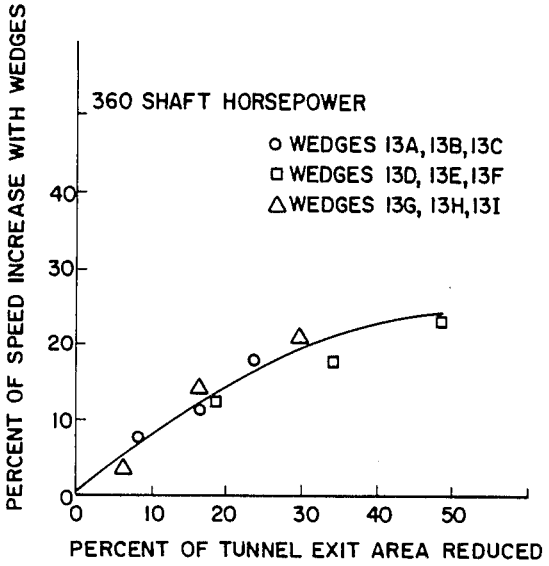
Figure 6G:
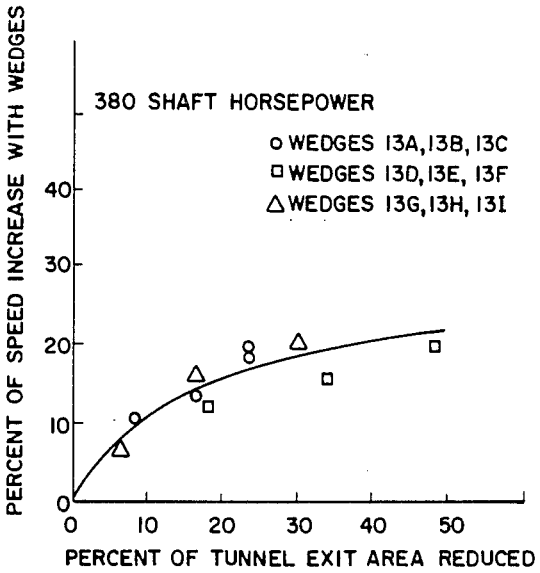

Referring now to FIGS. 5A, 5B and 5C, there are illustrated views of a third embodiment of tunnel wedge 13 positioned in shaft tunnel 12 of a waterborne craft 10. As shown in FIGS. 5A and 5B, tunnel wedge 13 can be a partial wedge extending inward from the sides 12A and 12B of tunnel shaft 12 so as to leave top 12C open to the original tunnel circumference. Tunnel wedge 13 may be built up in segments so as to yield different sized wedges, illustrated here by wedges 13G, 13H and 13I. As shown in FIGS. 5A and 5C, the partial tunnel wedge of this embodiment tapers downward to the bottom of craft 10 as wedge 13 extends forward into the tunnel. The inner faces of wedges 13G, 13H and 13I are not curved but instead present a flat surface which extends into the shaft tunnel.

For a waterborne craft such as an LCP(L) MK 11 Hull 36PL6641 having a shaft tunnel radius R of 14 inches, a wedge length L of 12 inches and wedge heights $H_7$, $H_8$, and $H_9$ of 2 inches, respectively, Table III illustrates the percent of tunnel exit area closed by partial wedges 13G, 13H and 13I.

TABLE III

| WEDGE | WEDGE ANGLE DEGS | PERCENT OF TUNNEL EXIT AREA CLOSED |
|---|---|---|
| 13G | 27.5 | 0.30 |
| 13H | 19.5 | 0.17 |
| 13I | 10.6 | 0.06 |

FIGS. 6A–G are graphs depicting percent of speed increase for the percent of tunnel exit area reduced for wedges 13A–I with engines having 260, 280, 300, 320, 340, 360 and 380 shaft horsepower in a waterborne craft such as an LCP(L)MK 11 Hull 36PL6641.

Figure 7A:
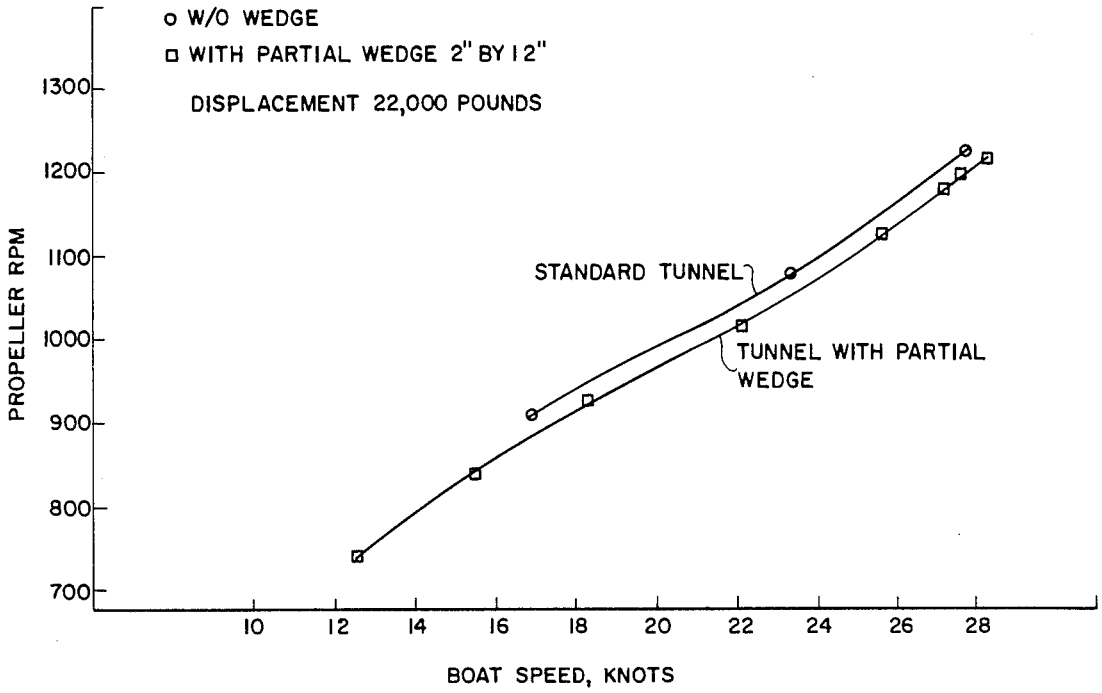
FIGS. 7A, 7B, 7C and 7D illustrate in graphic form the propeller RPM or shaft horsepower versus speed in knots for a standard tunnel and a tunnel provided with either full or partial tunnel wedges.
Figure 7C:
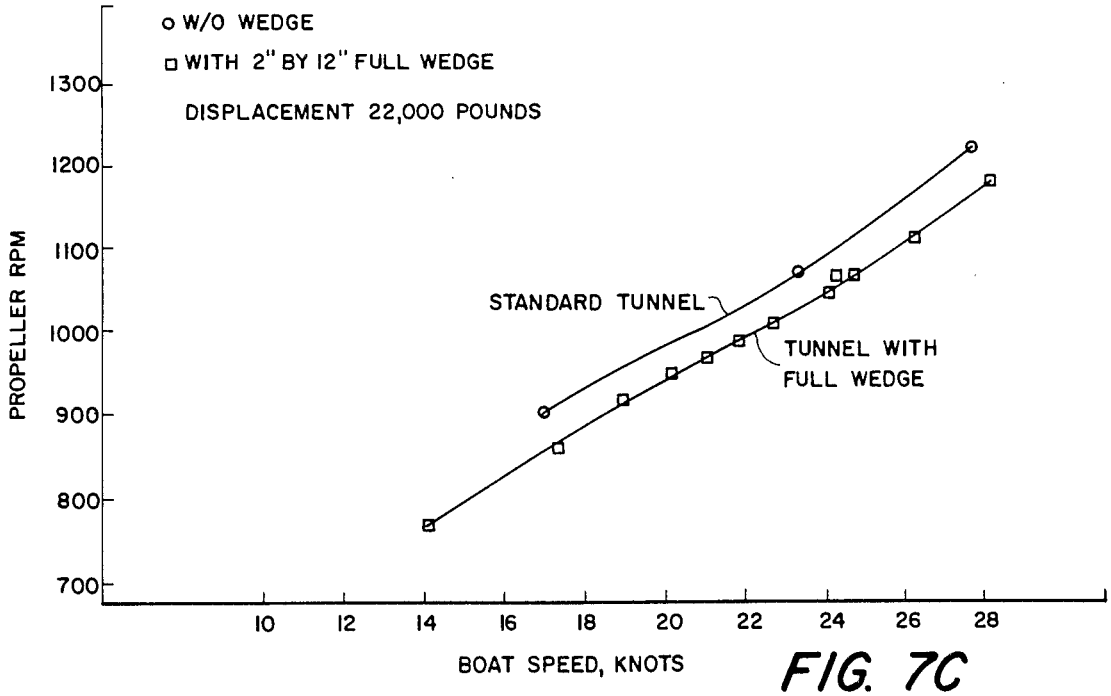
Figure 7B:
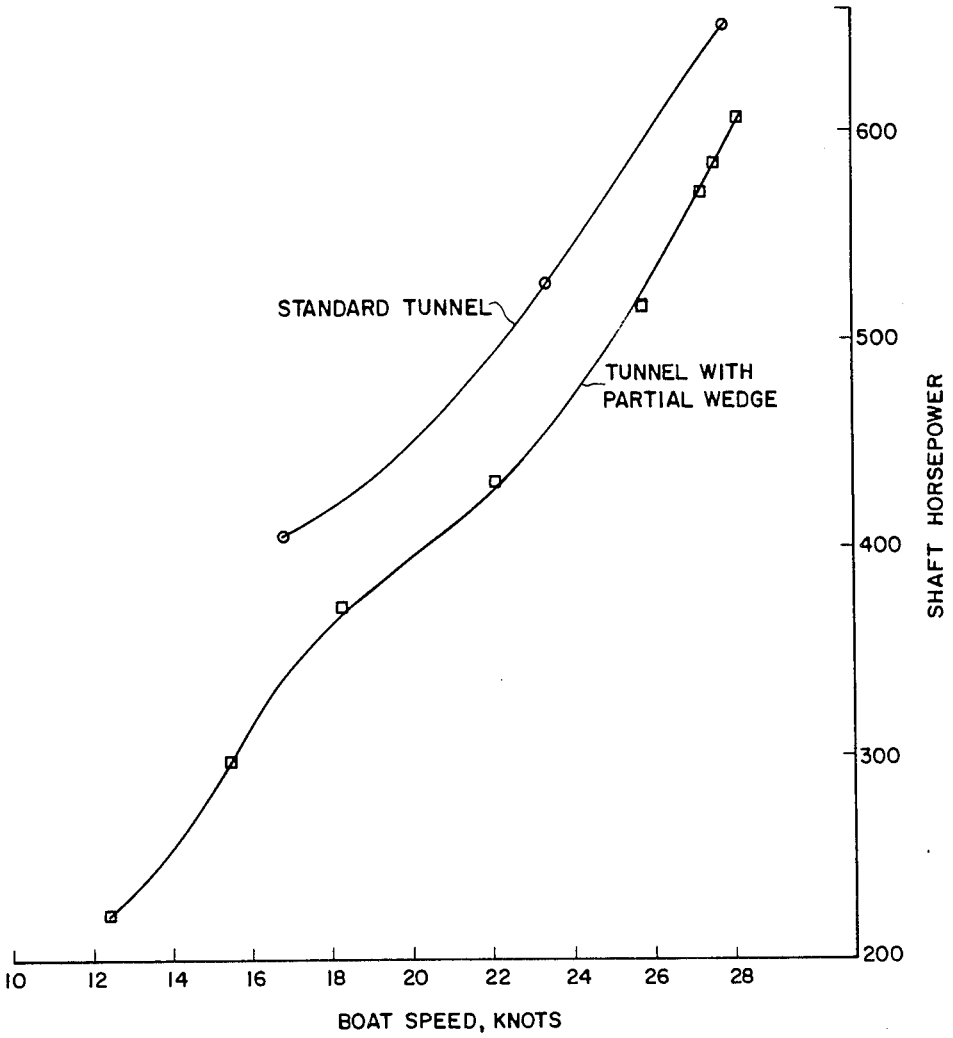

FIGS. 7A and 7B, in conjunction with Table IV, illustrate the decrease in shaft horsepower and RPM necessary to maintain a given speed in knots for a propeller shaft tunnel having a partial wedge such as wedges 13A, 13B or 13C, see FIG. 3A, as opposed to a standard tunnel without a wedge.

TABLE IV

| SPEED KNOTS | SHP W/O WEDGE | SHP WITH WEDGE | 1- WITH WEDGE W/O WEDGE |
|---|---|---|---|
| 18 | 417 | 364 | 0.13 |
| 20 | 448 | 395 | 0.12 |
| 22 | 491 | 425 | 0.13 |
| 24 | 543 | 472 | 0.13 |
| 26 | 599 | 530 | 0.12 |
| 28 | 660 | 597 | 0.10 |

Figure 7D:
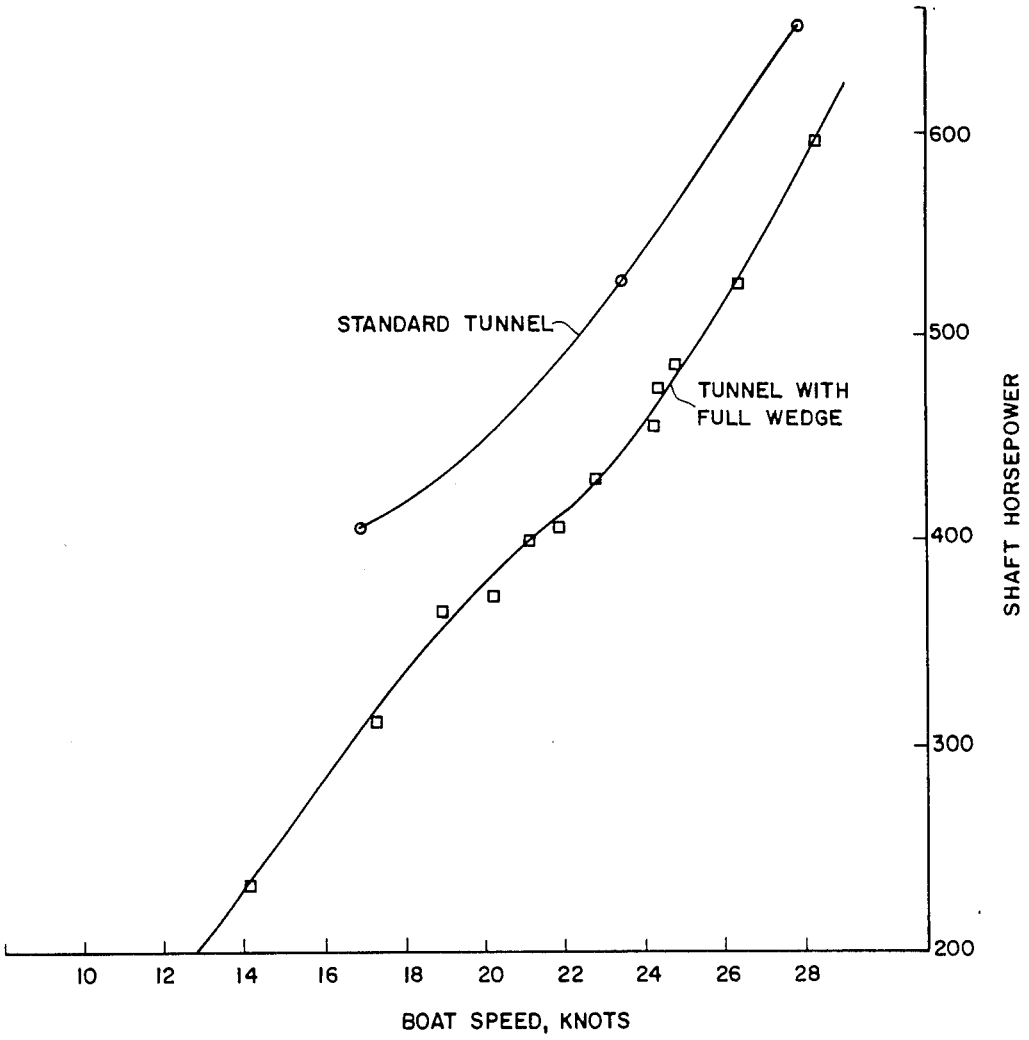

FIGS. 7C and 7D, in conjunction with Table V, illustrate the decrease in shaft horsepower and RPM necessary to maintain a given speed in knots for a propeller having a full wedge such as wedges 13D, 13E or 13F, see FIG. 4A, as opposed to a standard tunnel without a wedge.

TABLE V

| SPEED KNOTS | SHP W/O WEDGE | SHP WITH WEDGE | 1- WITH WEDGE W/O WEDGE |
|---|---|---|---|
| 18 | 417 | 334 | 0.20 |
| 20 | 448 | 377 | 0.16 |
| 22 | 491 | 412 | 0.16 |
| 24 | 543 | 456 | 0.16 |
| 26 | 599 | 617 | 0.14 |
| 28 | 660 | 587 | 0.11 |

It is apparent that the disclosed full or partial tunnel wedge provides a means for increasing water pressure aft of the propeller on a waterborne craft by converging the water flow aft of the propeller. The full or partial tunnel wedge reduces the shaft horsepower and RPM's required to attain a given operating speed and thus reduces fuel consumption and increases the operating range of a waterborne craft.

Many obvious modifications and embodiments of the specific invention, other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the United States is:

1. A device for reducing the shaft horsepower required to attain an operating speed in a waterborne craft, said craft having a bottom, a bow, a stern and a semi-cylindrical shaft tunnel in the bottom housing a propeller shaft and propeller, said tunnel opening to the bottom and to the stern of the craft, comprising:

a semi-cylindrical wedge positioned on an inner surface of the shaft tunnel to reduce the exit area of the tunnel in the bottom and stern of the craft.

2. A device for reducing the shaft horsepower required to attain an operating speed in a waterborne craft, said craft having a bottom, a bow, a stern and a semi-cylindrical shaft tunnel in the bottom housing a propeller shaft and propeller, said tunnel opening to the bottom and opening to the stern of the craft to form an exit area, comprising:

a pair of opposed partial wedges positioned on an inner surface of the shaft tunnel to reduce the exit area of the tunnel in the bottom and stern of the craft.

* * * * *